US012035797B2

(12) United States Patent
Asante et al.

(10) Patent No.: US 12,035,797 B2
(45) Date of Patent: Jul. 16, 2024

(54) SYSTEMS AND METHODS FOR UNRAVELING BRAIDS

(71) Applicants: Zanbria Asante, Pflugerville, TX (US); Bradley Scott McDonald, Cedar Park, TX (US)

(72) Inventors: Zanbria Asante, Pflugerville, TX (US); Bradley Scott McDonald, Cedar Park, TX (US)

(73) Assignee: Swella Inc.

( * ) Notice: Subject to any disclaimer, the term of this patent is extended or adjusted under 35 U.S.C. 154(b) by 0 days.

(21) Appl. No.: 17/704,929

(22) Filed: Mar. 25, 2022

(65) Prior Publication Data

US 2022/0304442 A1 Sep. 29, 2022

Related U.S. Application Data

(60) Provisional application No. 63/166,901, filed on Mar. 26, 2021.

(51) Int. Cl.
*A45D 7/00* (2006.01)
*A45D 2/00* (2006.01)

(52) U.S. Cl.
CPC ..... *A45D 7/00* (2013.01); *A45D 2/00* (2013.01); *A45D 2002/005* (2013.01); *A45D 2007/004* (2013.01)

(58) Field of Classification Search
CPC ..... A45D 8/34; A45D 2002/005; A45D 2002/006; A45D 2007/004; A45D 2007/005; A45D 2/00; A45D 2024/005
USPC ..... D28/10, 99
See application file for complete search history.

(56) References Cited

U.S. PATENT DOCUMENTS

| | | | |
|---|---|---|---|
| 8,479,749 | B2 | 7/2013 | Randolph |
| 11,464,310 | B2 | 10/2022 | Denoon |
| 2007/0056602 | A1 | 3/2007 | Love-Johnson |
| 2022/0000242 | A1 | 1/2022 | Green et al. |
| 2022/0248825 | A1 | 8/2022 | Mabatano-Harris |
| 2022/0273083 | A1 | 9/2022 | Casimir |

*Primary Examiner* — Cris L. Rodriguez
*Assistant Examiner* — Karim Asqiriba
(74) *Attorney, Agent, or Firm* — Howard University School of Law; Darrell G. Mottley

(57) ABSTRACT

Systems and methods for unraveling braids of real/natural hair and/or synthetic braid extensions, or a combination thereof, work from the bottom of the braid up using one or more tines automated to repetitively penetrate the braid and pull through and down it to unravel it. The systems and methods may unravel braid/entanglements faster than could otherwise be done manually by hand.

8 Claims, 9 Drawing Sheets

SYSTEMS AND METHODS FOR UNRAVELING BRAIDS

RELATED APPLICATIONS

The present application claims the benefit of U.S. Provisional Patent Application Ser. No. 63/166,901, filed Mar. 26, 2021.

TECHNICAL FIELD

The present disclosure relates generally to managing hair braids and, more specifically, to automating the unraveling or unwinding of hair braids.

BACKGROUND

Hair braids are popular and stylish, and many people will spend the time and money styling their hair with them. But taking the braids down, unraveling, or untwisting them often is an arduous task. Substantial time may need to be blocked off to do so manually and repetitively by hand, often causing discomfort because hands need to be raised up for a significant time period. Black women, for example, may spend anywhere between 3-8 hours manually unraveling ~100-120 braids, causing much dread. As a result, some women keep their braids intact for long time periods, perhaps ~6 weeks, just because of the time commitment involved. Also, the lack of mobility, requiring one to sit in place to take each braid down, can be tedious. These inconveniences may mean that braids have to be unraveled while one is on a video or other call, or require skipping dinner, or even taking time off work. Although some manual tools have been used to aid in unraveling, such as a rattail comb, the process can still be time consuming and repetitive. One alternative is to pay for a hairstylist to unravel the braids, but this can be expensive, costing perhaps up to $180 and still taking up to three hours. Another alternative is to have a friend unravel the braids, which may require giving the friend an incentive, such as paying for lunch. The process remains manual and monotonous even with these alternatives.

SUMMARY

Considering the issues identified above, there is a need for other devices and methods to help unravel braids, such as braids 10-12 inches in length that have three or more interlaced or woven strands of real/natural hair and/or synthetic braided extensions. An individual user at home or elsewhere or a hair care professional at a salon may use such devices and methods to unravel braids, in accordance with embodiments of the present disclosure. These devices and methods may work from the bottom of the braid up to the top or to another stopping point along the way by using tines, in a sense, as fingers, that are automated to repetitively penetrate the braid and pull through or down it to unravel it. The disclosed devices and methods may be able to unravel any hair braid or entanglement at a faster rate than could otherwise be done manually and may cost less than the price of going to a salon.

The exemplary types of braids that devices and methods disclosed herein may be able to unravel include: box braids; jumbo braids; micro-braids; French braids; Dutch braids; crocheted braids; lemonade braids; fishtail braids; feed-in braids; goddess braids; braided buns; tribal braids; cornrow braids; Fulani braids; waterfall braids; yarn braids; crown braids; butterfly braids; snake braids; triangle box braids; Senegalese twists; Senegalese twists braids; Halo braids; Ghana braids; tree braids; flat twists; plaits; cornrows; locs; Havana twists; Bantu knots; Nubian twists; etc. These devices and methods also may be able to undo other braided or twisted items, such as some knots in shoelaces.

Other systems, methods, features, and advantages of the present disclosure will be or become apparent to one of skill in the art upon examination of the following drawings and detailed description. It is intended that all such additional systems, methods, features, and advantages are included within this description, are within the scope of the present disclosure, and are protected by the accompanying claims.

BRIEF DESCRIPTION OF THE DRAWINGS

Aspects of the present disclosure may be better understood with reference to the following drawings, emphasis being placed upon clearly illustrating the principles of the present disclosure.

DETAILED DESCRIPTION

Figure 1:
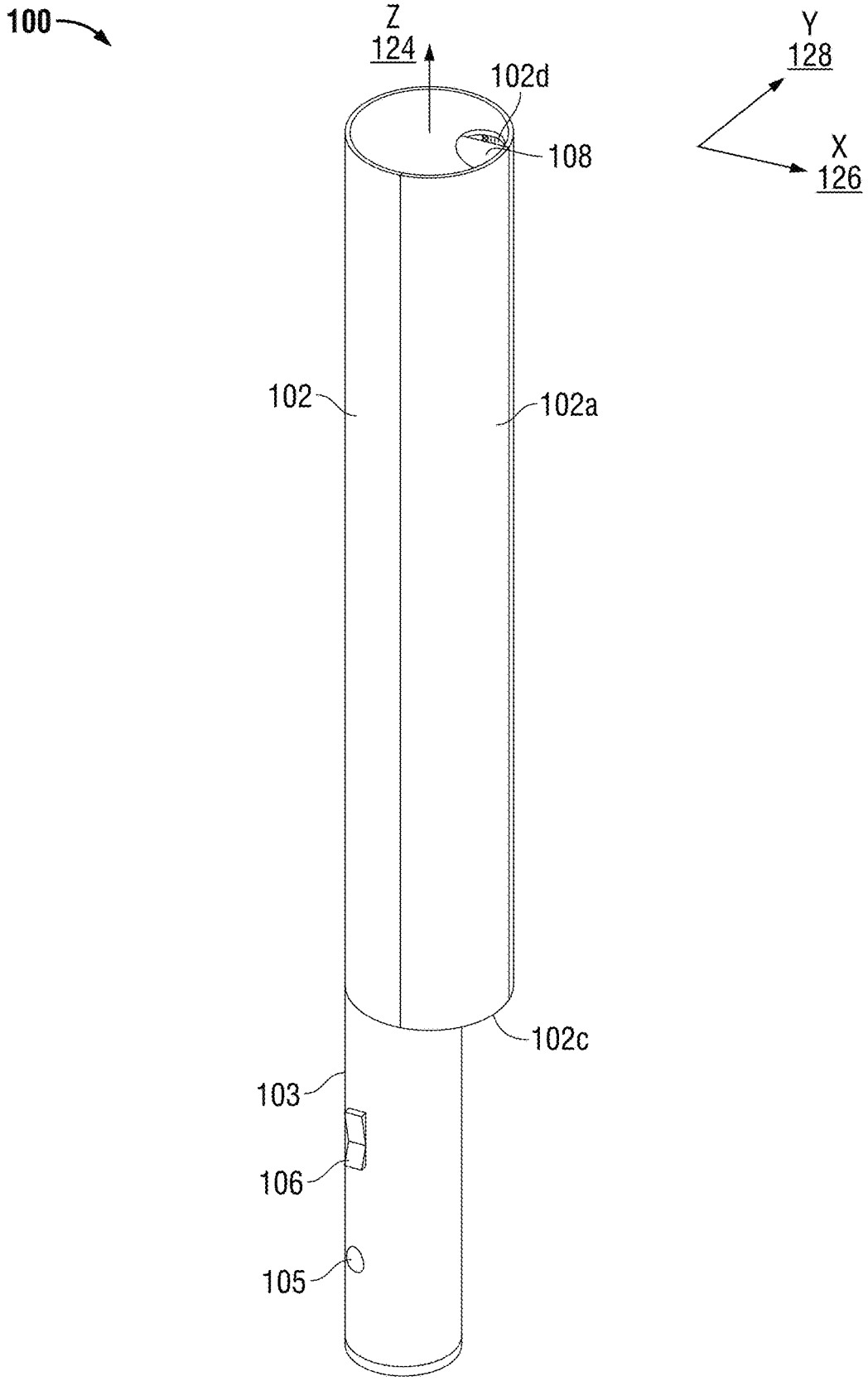
FIG. 1 shows an unraveling device in a perspective view, in accordance with exemplary embodiments of the present disclosure.

The present application claims the benefit of U.S. Provisional Patent Application Ser. No. 63/166,901, filed Mar. 26, 2021, which is hereby incorporated by reference for all purposes as if set forth herein in its entirety.

In the description that follows, like parts are marked throughout the description and drawings with the same reference numerals. The drawings and components in the drawings might not be to scale and certain components may be shown in generalized or schematic form and may be identified by commercial designations in the interest of clarity and conciseness.

As used herein, the singular forms "a", "an", and "the" are intended to include the plural forms as well, unless the context clearly indicates otherwise. It should be further understood that the terms "comprise" and/or "comprising," when used herein, specify the presence of stated features, integers, steps, operations, elements, components, and/or groups thereof, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y," "between about X and Y," and "between approximately X and Y" should be interpreted to include X and Y. Moreover, as used herein, "between about X and Y" means "between about X and about Y" and "between approximately X and Y" means "between approximately X and approximately Y," "from about X to Y" means "from about X to about Y," and "from approximately X to Y" means "from approximately X to approximately Y."

In the present disclosure, "hardware" can include a combination of discrete components, an integrated circuit, an application-specific integrated circuit (ASIC), a system-on-chip (SoC), a field programmable gate array (FPGA), or other suitable hardware. In the present disclosure, "software" can include one or more objects, agents, threads, lines of code, modules, subroutines, firmware separate software applications, or other suitable software structures operating in one or more software applications, in or on: one or more processors or CPUs (where processor includes a microcomputer or other suitable controller); memory devices; input/output (I/O) devices; displays; data input devices, such as a keyboard or a mouse; peripherals, such as printers or speakers; associated drivers; control cards or boards; power sources, network devices, including wireless options, such as WiFi or Bluetooth; docking station devices; or other suitable devices operating under control of software systems in conjunction with the one or more processors or other devices; or other suitable software handling structures. In one exemplary embodiment, software can include one or more lines of code or other suitable software structures operating in a general-purpose software application, such as an operating system, and one or more lines of code or other suitable software structures operating in a specific or special purpose software application. As used herein, the term "couple" and its cognate terms, such as "couples," "coupled," and "coupling," can include a physical connection (such as through a copper conductor), a virtual connection (such as through randomly assigned memory locations of a data memory device), a logical connection (such as through logical gates of a semiconducting device), other suitable connections, or a suitable combination of such connections, and may be direct or indirect.

Embodiments of the present disclosure may automate the unraveling process of taking down braids/entanglements of hair that are clean (i.e., no beads, accessories, clips, etc.). These embodiments may integrate robotics, mechanics, or other automation, possibly operating faster than if done by hand or other methods, and may reduce the strain on fingers and hands that normally occurs with manual unraveling.

Figure 2A:
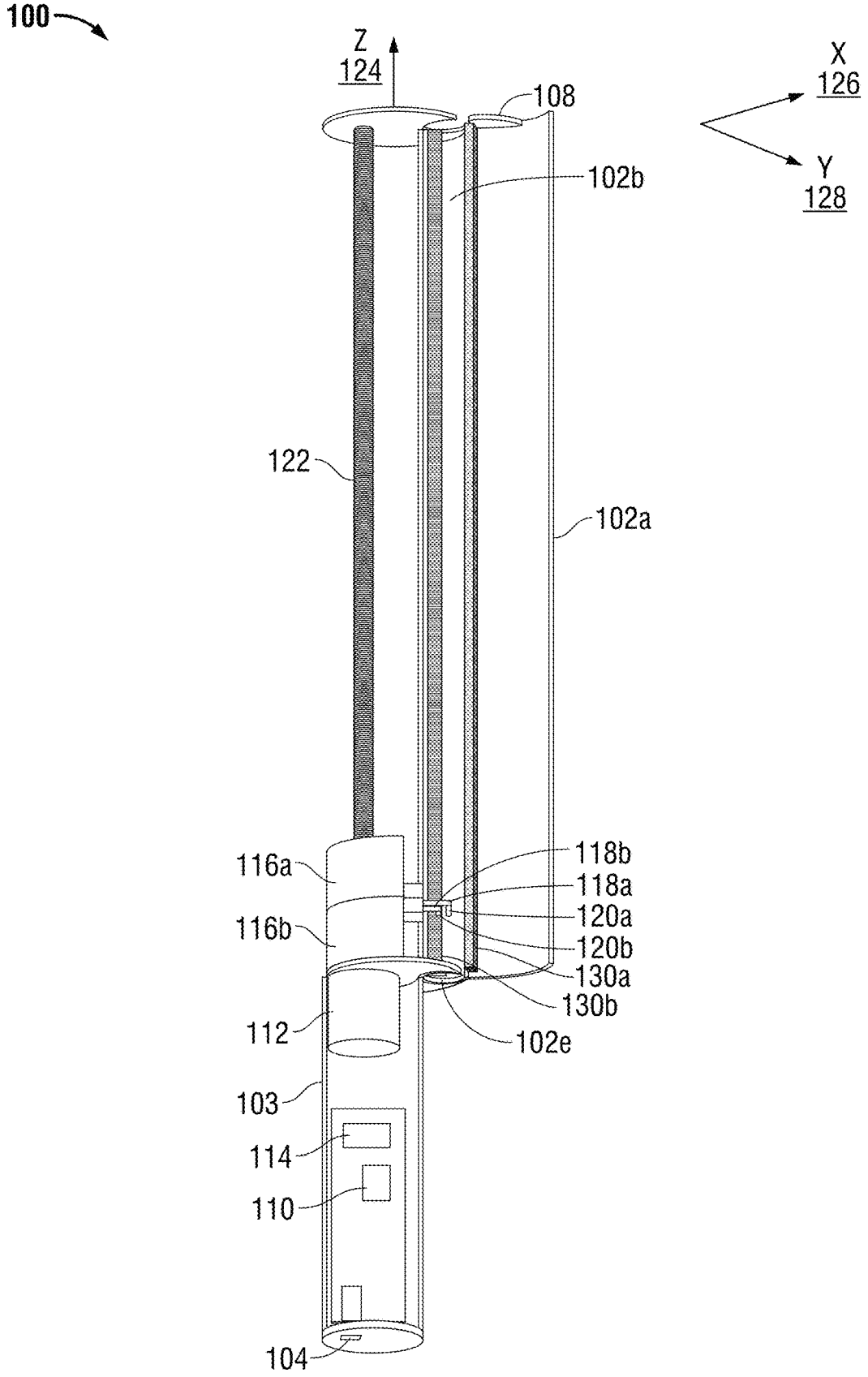
FIG. 2*a* shows the embodiment of FIG. 1 in a perspective view with a portion of a cover removed for ease in illustrating internal structure and components.
Figure 2B:
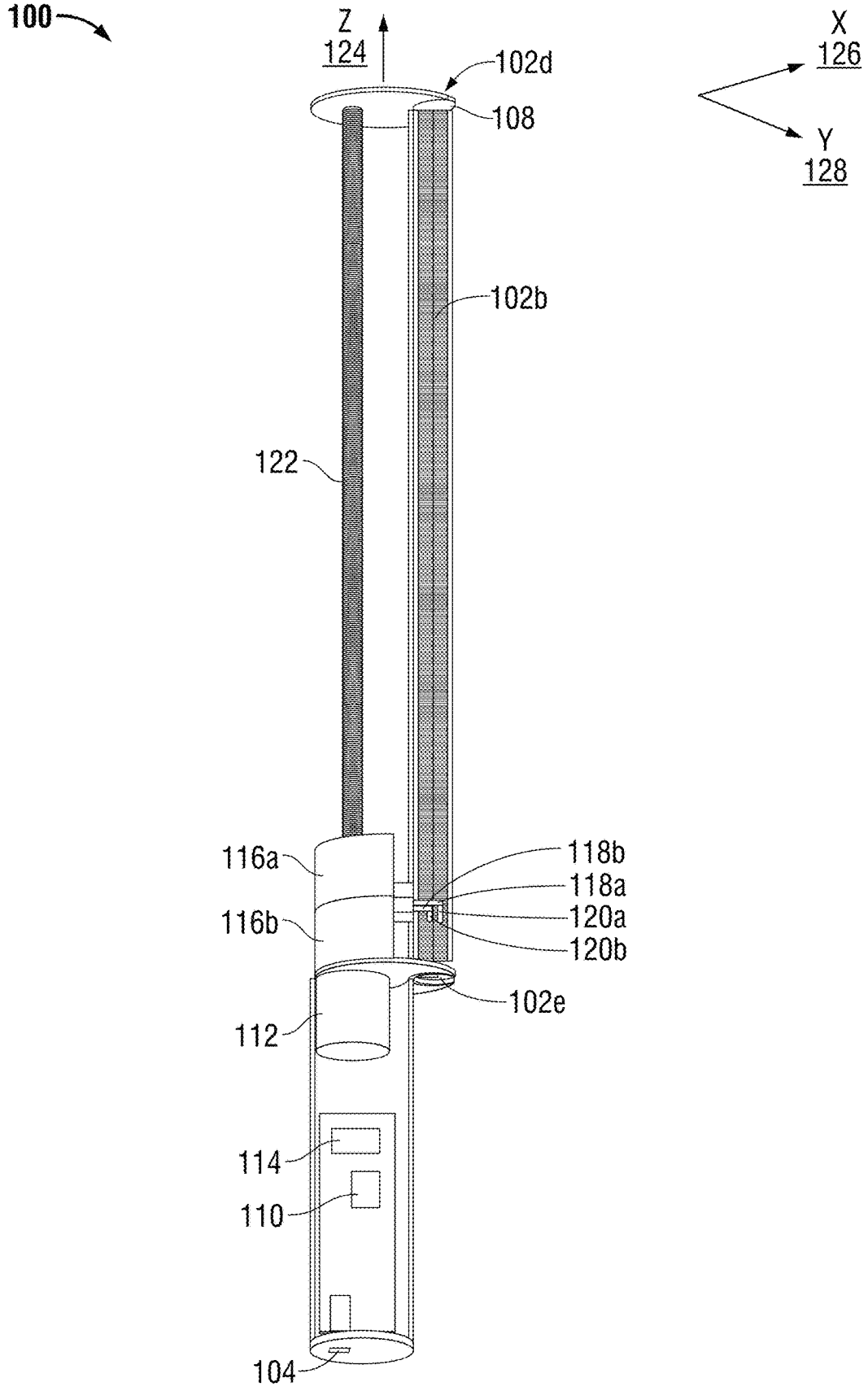
FIG. 2*b* shows the embodiment of FIG. 1 in a perspective view with more portions of the cover removed for ease in illustrating internal structure and components.

FIG. 1 shows an unraveling device 100 in a perspective view, which is a system for unraveling a braid, in accordance with an exemplary embodiment of the present disclosure. FIGS. 2*a* and 2*b* show the embodiment in FIG. 1 in a perspective view with portions of a cover or housing 102 removed for illustrative purposes and ease in showing internal structure and components of the device 100. The unraveling device 100, besides the housing 102, also includes various other components, such as a handle 103, electrical coupler or connector 104 (e.g., for supplying power, battery charging/recharging, and/or for unidirectional or bidirectional communications of data and control signals (the latter if the device 100 is wired to a computer, tablet, smartphone, or the like), a battery (not shown), on/off switch 105, and failsafe switch, button, or haptic 106. The electrical connection 104 may be for USB, micro-USB, Lightning®, or the like type of couplings or connectors, as would be understood by one of ordinary skill in the art. Although a battery(ies) (hereinafter, "battery"), such as a rechargeable battery, is not specifically shown in FIG. 2*a* or 2*b*, it may be located within the handle 103 or elsewhere within the device 100, as a particular design choice. The battery would be of a type and have a rating (e.g., in Watt-hours (Wh)) sufficient to supply power to the device 100 to last for at least one hour of continuous use, such as a lithium ion, lithium polymer, or the like, battery, as would be understood by one of ordinary skill in the art. The battery may be chosen to minimize the weight of the device 100 and be swappable. The power supplied may be in the 15-20 Wh range, for example, by a ~19.2 Wh pack (7.4V, 2600 mAh), which currently may be found at https://www.amazon.com/BM-2-Pack-Batteries-Battery-Charger/dp/B00WH2LYAO/ref=sr_1_6?c=ts&keywords=Camera+Batteries&qid=1646928 608&s=photo&sr=1-6&ts_id=11041791). Alternatively, or in addition, the device may include an AC power cord that includes an appropriate transformer to convert AC to supply DC power to the device 100 and recharge the battery, for example, through the coupler 104.

As illustrated in FIGS. 2*a* and 2*b*, the unraveling device 100 may also include a processor, CPU, control unit or controller board 110 (hereinafter, controller board 110), a motor 112, which may be closed loop stepper motor for control purposes, hardware and/or software motor (e.g., stepper motor) control drivers 114, and linear actuators 116*a* and 116*b*, which may be open or closed loop actuators, that have corresponding linear actuator arms 118*a* and 118*b* and corresponding tines 120*a* and 120*b* coupled thereto, respectively. The motor 112 and the actuators 116*a* and 116*b* are electromechanical drives, that when actuated, are configured to move the tines 120 and 120*b* in the XYZ dimensions to unravel the braid. Exemplary stepper motors could be a NEMA 11, hybrid stepper motor (e.g., 17 oz-in torque) with an encoder for feedback and a 5:1 gearbox or a NEMA 14 (e.g., 60 oz-in torque) with no gear box or with a 2:1 gearbox. The former may be a NEMA 11 Closed-loop Geared Stepper, No. 11HS20-0674D-PG5-E22-300, available at www.oyostepper.com, and the latter may be a NEMA 14 Closed Loop Stepper Motor, P/N 35HS60-1204D-E1000, available at www.frankhumotor.store, or a NEMA 14 Standard Hybrid Stepper Motor, model MS14HS5P4150-M, available at www.moonindustries.com. Exemplary linear actuators could be Product Code PQ12-S Linear Actuator with Limit Switches, available from Actuonix Motion Devices® at www.actuonix.com, or a DC 3V-5V 2-phase 4-wire 5 mm Precision Planetary Metal Gearbox Gear Stepper Motor, RM11.14, available at www.lazada.com. Some of these components may be included in, as part of, or coupled to the handle 103, as shown in FIGS. 2*a* and 2*b*, although they may be located elsewhere in the device 100, as a particular design choice. The device 100 may also include a threaded member 122, such as a rod or screw, longitudinally elongated in a direction along a Z axis 124 (longitudinal axis of the device 100) and coupled to and driven rotationally about the Z axis 124 by the motor 112, for example through a system of gears or gear drive (not shown). A bearing at the bottom of the threaded rod 122 at or near the handle 103 and a bearing or a bushing at its top may be used to allow the threaded rod 122 to rotate when driven by the motor 112. The linear actuators 116*a* and 116*b* are also threadedly coupled to the threaded rod 122 such that when the rod 122 is rotated or turned by activation of the motor 112, the linear actuators 116*a* and 116*b* move along (i.e., ride up or down) the rod 122 in a direction along the longitudinal axis 124.

As indicated in FIGS. 2*a* and 2*b*, the tine 120*a* is coupled to the actuator arm 118*a*, which in turn, is coupled to the linear actuator 116*a*. Similarly, the tine 120*b* is coupled to the actuator arm 118*b*, which in turn, is coupled to the linear actuator 116*b*. The tines 120*a* and 120*b* may be coated in or with a material that aids in preventing or reducing binding when in contact with the braid, such as Teflon or the like. The size or length of the arms and the tines will be dependent on or designed based on the width of the pipe 102*c* and the depth of the braid channel 102*b* from the retainers 130*a* and 130*b* (when the lid 102*a* is closed) to allow the tines to just reach or just touch, at their maximum extension, the surface or wall of the braid channel inside the device 100 and the arm length, at maximum extension, to just reach or touch the far side of the braid channel. It is preferable that the depth penetrated within or through the braid by the tines 120*a* and/or 120*b* should be controlled. In some instances, as needed, or as desired, enough pulses or other signals may be sent by the processor in the controller board 110 to the actuators 116*a* and/or 116*b* to push or move the tines 120*a* and/or 120*b* all the way through the braid to contact the braid channel 102*b* and stop there before pulling the braid down. In other instances, such as for a thicker braid, the tines 120*a* and/or 120*b* may be controlled such the braid may only penetrate through a portion of the braid, for example, halfway through before starting the pull down. If the tines 120*a* and/or 120*b* are determined to be or become stuck, the processor may issue enough pulses to move them out of the braid and/or to the home position to try to move into or through the braid again.

In certain embodiments, the tines 120*a* and 120*b* may be polished to help avoid tangling of or with the braid. For differently sized or types of natural hair braids or synthetic braids, or a combination of both, differently sized tines 120*a* and 120*b* may be included as part of a package with the device 100 or otherwise made available for purchase by the user. In certain embodiments, the anti 118*a* and 118*b* may have their respective tines 120*a* and 120*b* formed as part of or integrated with them. And in certain embodiments, the arms 118*a* and 118*b* may be removably attachable with a locking or clipping attachment mechanism to their respective actuators 116*a* and 116*b*. Such a locking mechanism may be the same as or similar to the type of locking mechanisms used to lock the beaters of a hand-held mixer to the mixer body, as would be understood by one of ordinary skill in the art. The arms 118*a* and 118*b*, for example, may simply be pushed into the locking mechanism in the actuators 116*a* and 116*b* or be pushed in and then turned to lock them in place with their removal being accomplished through the opposite motion. Alternatively, or instead, differently sized tines 120*a* and 120*b* may be removably attachable and swappable to their respective arms 118*a* and 118*b*, the latter of which may form part of or be integrated with their respective actuators 116*a* and 116*b*. In that case, the tines 116*a* and 116*b* may be removably attachable with a locking mechanism or clipping attachment to their respective arms 118 and 118*b*. Such a locking mechanism, in some embodiments, may include corresponding sleaves for the tines 120*a* and 120*b* to be inserted into, each with a lock bearing like a socket set wrench. In other embodiments, the mechanism instead may include corresponding retractable sleeves like the quick releases on an impact wrench to hold the tines 120*a* and 120*b*.

Transverse motion of the tines 120*a* and 120*b* (i.e., motion anywhere in the XY plane, as defined by X axis 126 and Y axis 128 (both perpendicular to the Z axis 124) is provided through independent motion of their corresponding arms 118*a* and 118*b*, as driven by activation of their corresponding actuators 116*a* and 116*b*. For example, the actuators 116*a* and 116*b* may include screws or screw-like mechanisms used to move the arms 118*a* and 118*b*, as would be understood by one of ordinary skill in the art. Thus, the tines 120*a* and 120*b*, although they can move independently of each other in the XY plane, move together in the Z direction as the actuators 116*a* and 116*b* and their respective arms 118*a* and 118*b* move in the Z direction 124. All such motion is under the control of the controller board 110 via software or app code as described below and occurs using the components of the device 100 as described herein. In certain embodiments, a design point for the force imparted by the actuators 116*a* and 116*b* via the arms 118*a* and 118*b* to move the tines 120*a* and 120*b* may be 2 lbs. per tine minimum. For motion of the actuators in the Z direction 124, the torque of the motor 112 may be converted into a higher torque for rotating the threaded rod to move the actuators linearly in the Z direction 124 with a slower rotation speed of the threaded rod compared to the motor 112. For example, a 5:1 gear box will convert 17 ounce-inch (oz-in) to 95 oz-in of torque (less efficiency loss) at ⅕ the rotation speed.

Referring again to FIGS. 2*a* and 2*b*, the housing 102 of the unraveling device 100 includes a lid 102*a* and a braid channel housing portion 102*b* (hereinafter, the braid channel 102*b*). The lid 102*a* is shown in FIG. 2*a* in an open position with respect to the braid channel 102*b* (i.e., the lid 102*a* is unlatched from the housing 102), exposing the braid channel 102*b* in the interior of the housing 102. The braid channel 102*b* and the lid 102*a*, when the latter is in the closed or latched position, together form an enclosed portion or pipe structure 102*c* aligned and elongated in the longitudinal Z direction 124 (see FIGS. 1, 3*a*, and 3*b*). When so closed, the pipe 102*c* will have a top opening 102*d* at the end of the pipe 102*c* and a bottom opening 102*e* at the lower end of the pipe 102*c* formed in the housing 102. The bottom opening 102*e* may have a slot on its side to make it easier to insert the braid into the device 100 (see FIGS. 2*a* and 2*b*) when the lid 102*a* is open. As will be described below, before unraveling, a user's braid will be placed within the braid channel 102*b* and the lid 102*a* will be closed such that the portion of the braid closest to the scalp of a user (not shown) will pass through the opening 102*d* and the other end of the braid, that is, the portion of the braid distal from the user's scalp, will extend within the pipe 102*c* toward or near the opening 102*e* (see FIGS. 4*a*-4*c*). As the braid is unraveled more and more, it will extend further and further in length within the pipe 102*c* (see FIGS. 4*b* and 4*c*) and it may, for certain length braids, begin to stick out of the opening 102*e* at the bottom of the pipe 102*c*. To aid in preventing or reducing tangling, the lower portion of the unraveled braid or hair may need to be pulled or stroked by hand, brush, comb, or other similar tool, such as a special comb with widely spaced tines, to reach up a small distance through the opening 102*e* from the bottom of the device 100, even while the device 100 is continues to operate to unravel the braid. The pulling or stroking of the unraveled portion will allow it to extend further and further out of the opening 102*e*. Or the user may alternate between stopping the device from unraveling to pull or stroke the unraveled portion and then starting the device 100 again to unravel, and so on until the braid is fully unraveled.

The pipe 102*c* formed by the braid channel 102*b* and the lid 102*a*, when closed, may generally be of hollow elliptical or hollow cylindrical shape in cross-section (i.e., in the XY plane). Alternatively, the pipe 102*c* may be a hollow cone or generally be of a hollow conical shape in cross-section with its major axis or axis of symmetry aligned in the longitudinal Z direction 124 with its wider portion toward the bottom or lower end of the pipe 102*c* and its narrower portion toward the top or upper end of the pipe 102*c*. The cone or conical shape may be advantageous for accommodating the expansion of the hair of the braid that may occur toward the lower portion of the pipe 102*c* as the braid becomes more and more unraveled, as is depicted by comparing FIGS. 4*b* and 4*c*. The cone or conical shape lower end may be provided as an "expander" that is removably attachable (e.g., lockable and unlockable) to the device 100 to allow for expansion of the unraveled portion of the braid. Differently sized expanders may be available as accessories or options, and may be based on the overall length of the device 100, or the length or other proportions of the braid to be unraveled.

Figure 3A:
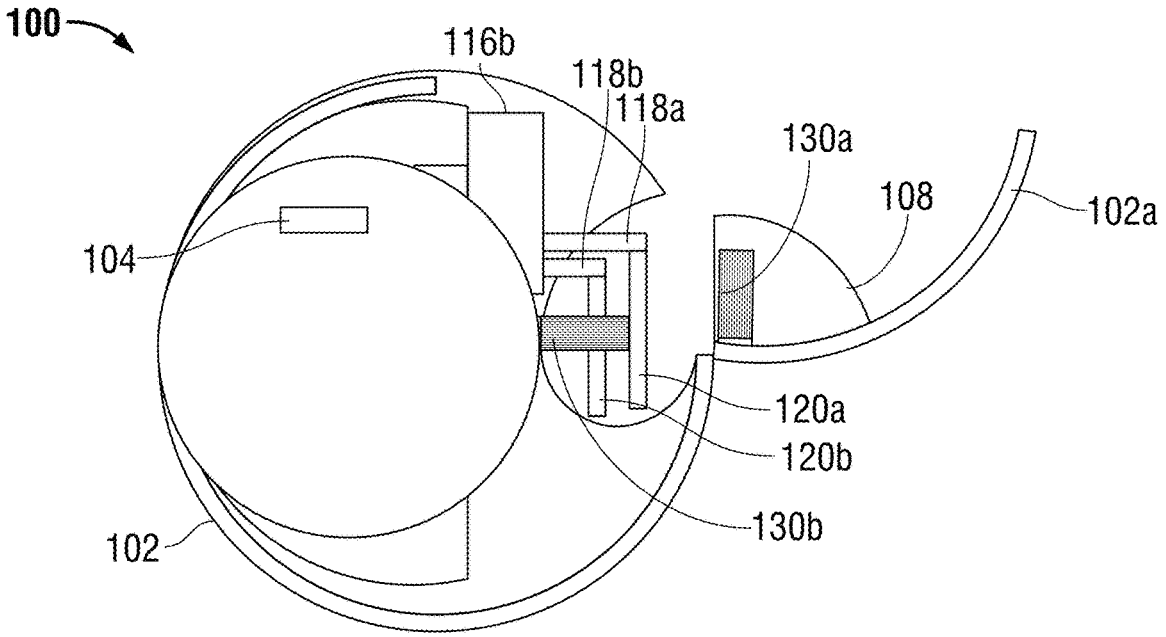
FIG. 3*a* shows a cross-sectional view of the embodiment of FIG. 1 with a lid in an open position.
Figure 3B:
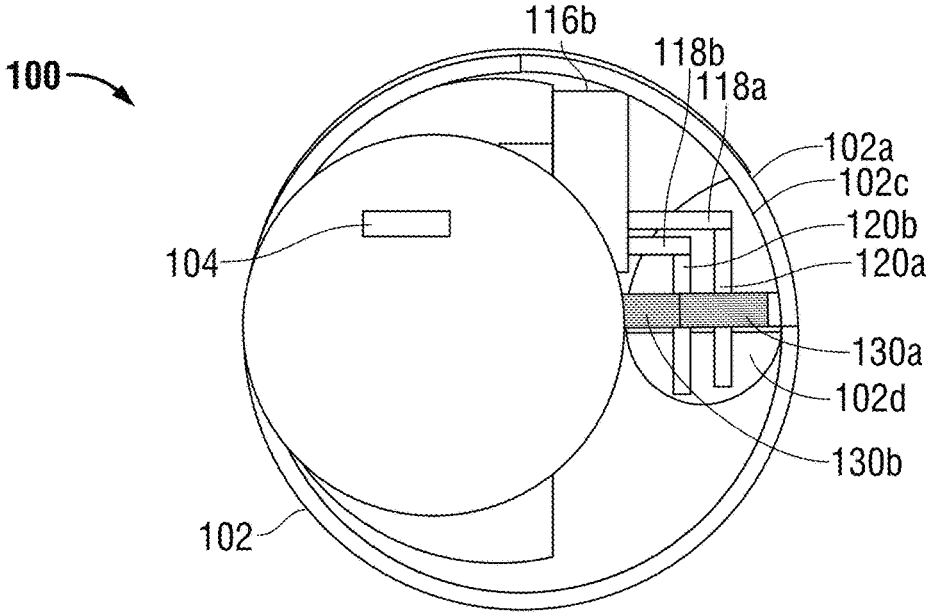
FIG. 3*b* shows a cross-sectional view of the embodiment of FIG. 1 with the lid in a closed position.

As seen in FIG. 2*a*, both the braid channel 102*b* and an interior of the lid 102*a* include braid retainers or retaining structures 130*a* and 130*b*, respectively, which may be brushes. When brushes are used, they may be similar to or analogous to the type of brushes used, for example, for weather stripping or the like, or they may have bristles, such as silicone bristles, or the like. The retainers 130*a* and 130*b* may be removably or permanently affixed or attached to, or inserted along or through, corresponding guide channels, tracks, or grooves (not shown) built into the braid channel 102*b* and the interior side of the lid 102*a* along the longitudinal Z direction 124. The retainers 130*a* and 130*b* may be removable for purposes of replacing them with different sized retainers 130*a* and 130*b* or for cleaning. The retainers 130*a* and 130*b* may alternatively or instead be glued or epoxied to or along the respective guide channels, tracks, or grooves or along the interior surfaces of the braid channel 102*b* and the lid 102*a*. When the lid 102*a* is in the closed position, the retainers 130*a* and 130*b* come together to touch each other, or are sufficiently proximate to each other, along the longitudinal Z direction 124 to completely retain or substantially retain the braid (and the unraveled portion of the braid if unraveling has started) underneath the retainers 130*a* and 130*b*. FIGS. 3*a* and 3*b* illustrate, in XY-plane cross-sectional views, how the retainers 130*a* and 130*b* may appear when the lid 102*a* is in the open position and when they come together when the lid 102*a* is in the closed position, respectively. In FIGS. 3*a* and 3*b*, the lower portion of the housing 102 of the device 100 defining the opening 102*e* is not shown for clarity purposes.

Figure 4A:
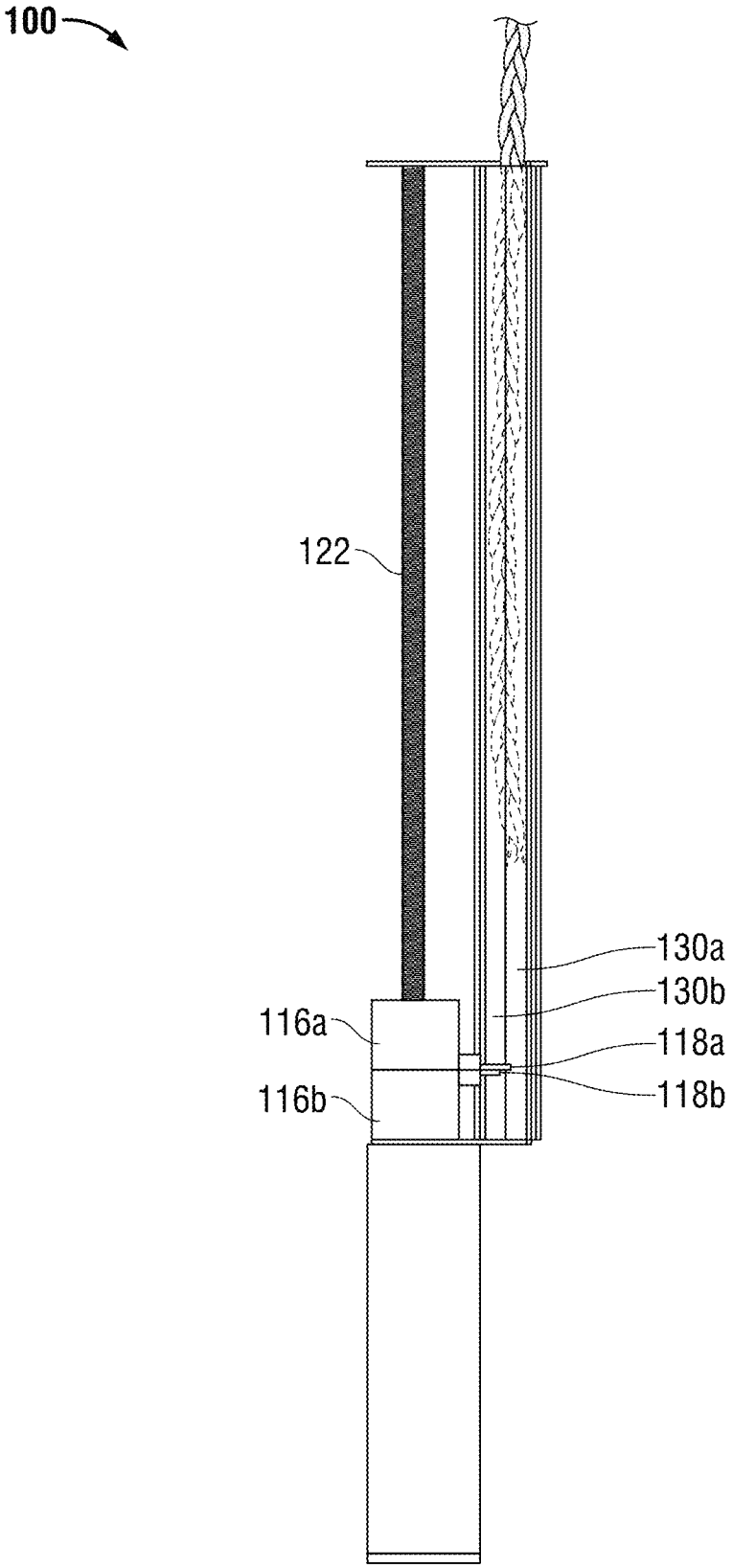
FIG. 4*a* shows a braid after being inserted into the embodiment of FIG. 1.
Figure 4B:
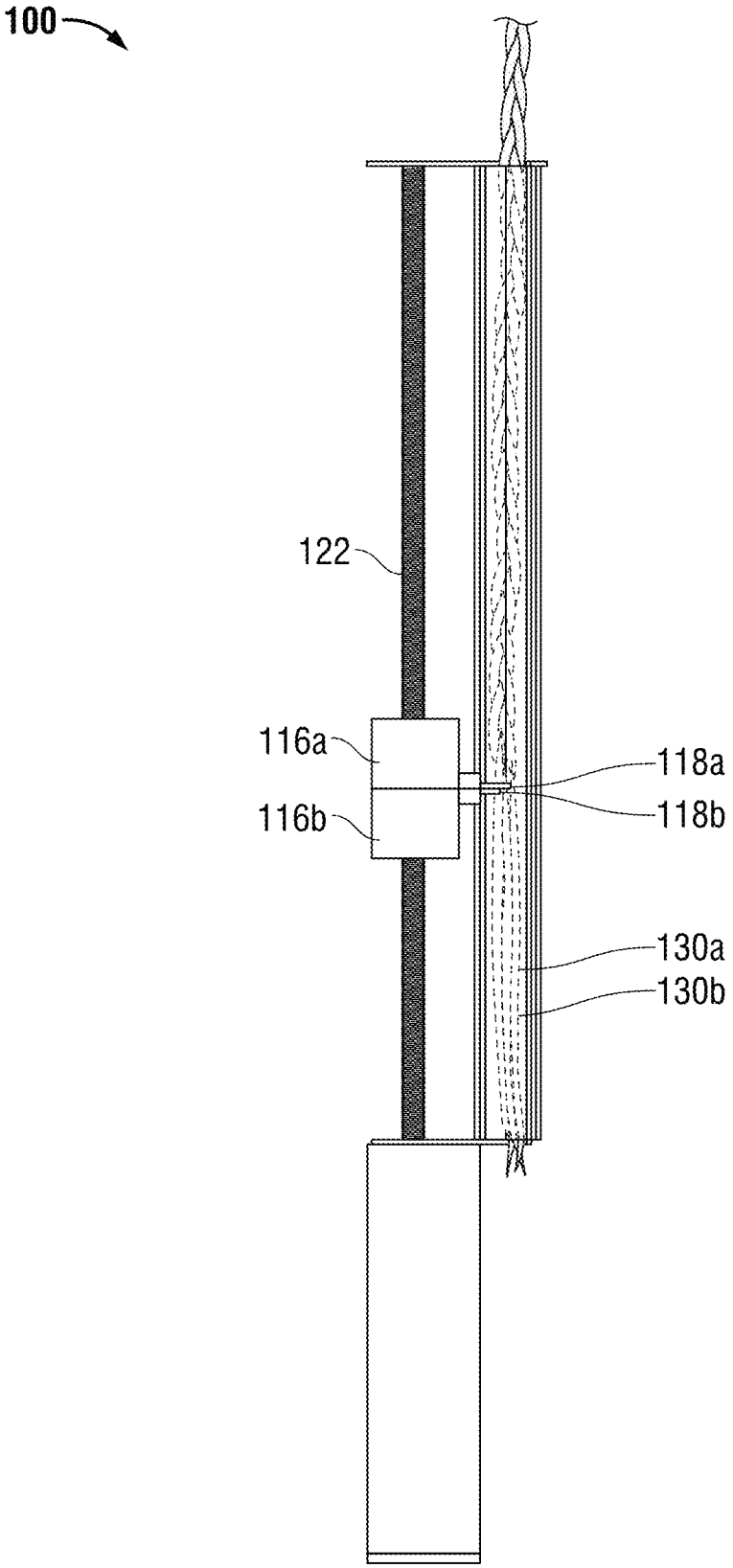
FIG. 4*b* shows a braid after being inserted into the embodiment of FIG. 1 partially unraveled.

FIG. 4*a* illustrates a braid as it would appear after it is inserted into the unraveling device 100 underneath the retainers 130*a* and 130*b* (shown only schematically in FIG. 4*a*) within the braid channel 102*b* after the lid 102*a* is closed before any unraveling. In FIG. 4*a*, the lid 102*a* is not illustrated for clarity purposes (same for FIGS. 4*b* and 4*c*). The braid is exemplary of a type of braided/tangled hair that the device 100 can unravel. The braid may be formed only of a user's natural hair (person not shown) or attached to and braided with the user's natural hair to act as an extension thereof, as discussed above. The braid, for example, may be 10-12 inches in length, ⅜-inch in width, and ⅛-inch in depth. Other types of braids that may be unraveled by the device 100 can include jumbo-sized braids, having a depth or thickness of ¾-inches, down to smaller-sized braids, having a depth or thickness of ⅛-inch. Also, a loose braid of 10-12 inches length and having 64 entangled strands or a tight braid of up to 120 entangled strands may be unraveled. Other possible braids accommodated by the device 100 may be of longer length or larger size. Depending on the size or type of braid, different sized tines may be used for unraveling, as discussed above.

Figure 4C:
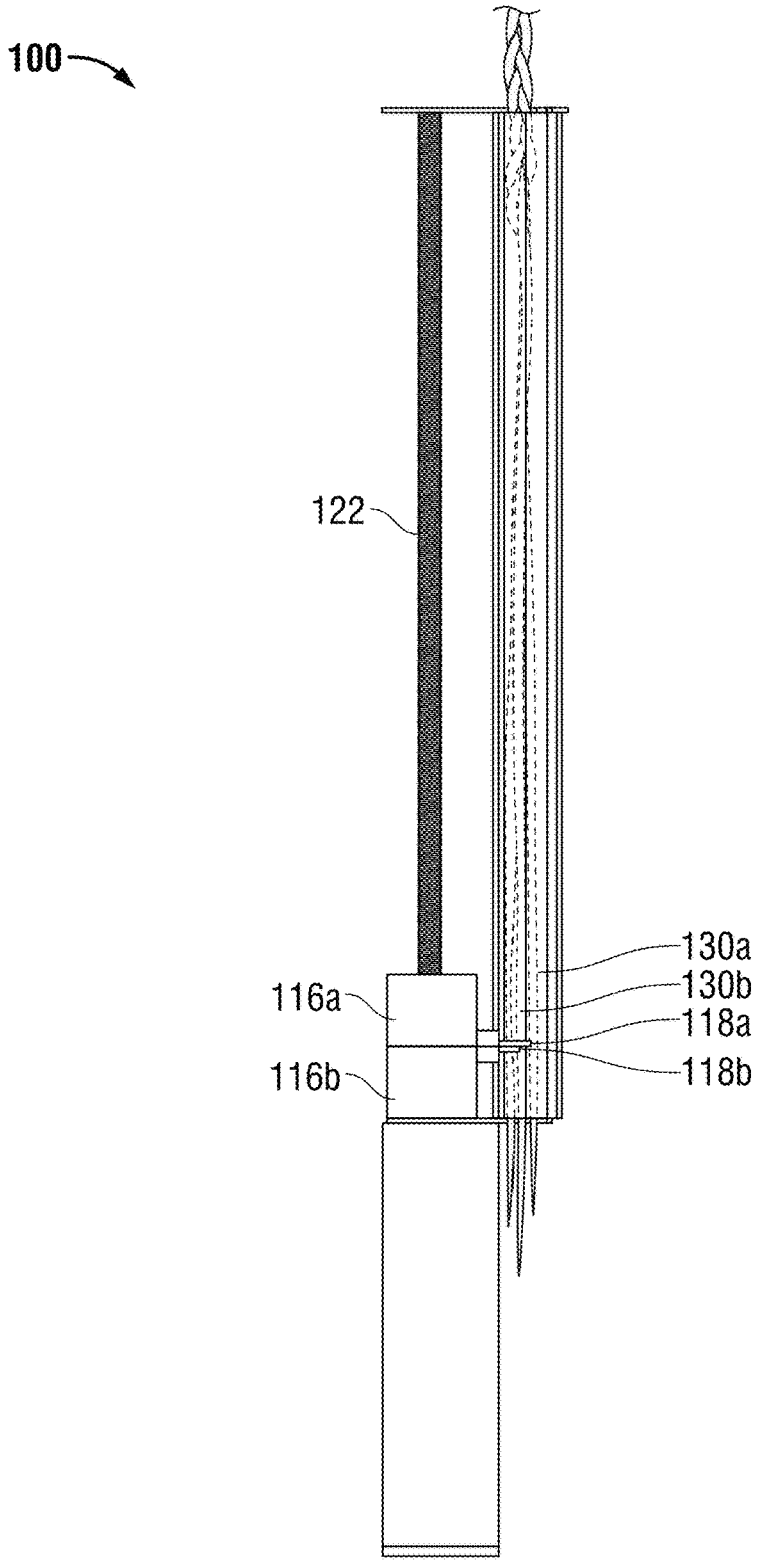
FIG. 4*c* shows a braid after being inserted into the embodiment of FIG. 1 completely unraveled.

Once the braid is fully inserted into the braid channel 102*b* underneath the retainers 130*a* and 130*b* with the lid 102*a* closed, the process of unraveling may begin. To unravel a braid, as explained above and further below, the arms 118*a* and 118*b* and the tines 120*a* and 120*b* move in the XY plane through activation of the linear actuators 116*a* and 116*b*, and they move in the Z-axis direction via motion of the actuators 116*a* and 116*b* as they are driven along the threaded rod 122. As unraveling proceeds, the unraveled lower portion of the braid will extend in length toward lower end of the pipe 102*c* and outside from below the lower end or bottom of the pipe 102*c* (see FIG. 4*b*, which shows the braid as it may appear when partially unraveled with the tines 120*a* and 120*b* in positions to continue the unraveling process, and also shows the retainers 130*a* and 130*b* only schematically). The user typically would use their free hand and fingers that are not holding the device 100, or a brush or comb held in that hand, or some other means, to help the unraveled lower portion to keep moving out the lower end of the pipe 102*c* and remain unraveled. It should be understood that the user of the device may not be the person whose hair is braided, and instead be another person, such as a hairstylist, hairdresser, or the like, who would be doing this for the person with the braid. FIG. 4*c* shows the braid as it may appear when completely unraveled and extending out the lower end of the pipe 102*c* (also shows the retainers 130*a* and 130*b* only schematically).

Figure 5:
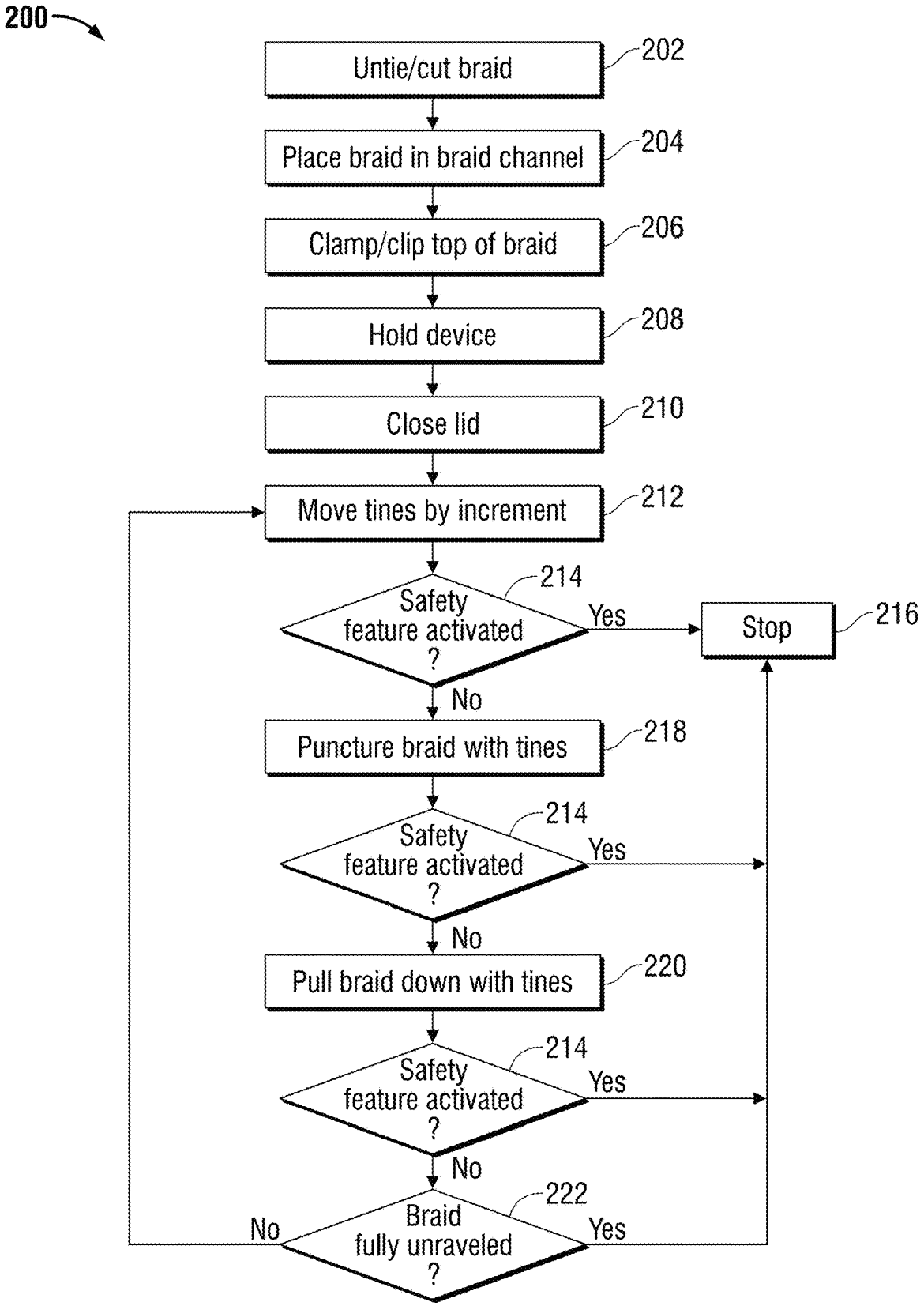
FIG. 5 is a flowchart of a method of using the embodiment of FIG. 1, in accordance with exemplary embodiments of the present disclosure.

FIG. 5 is a flowchart of a method 200 for unraveling the braids/entanglements, in accordance with an exemplary embodiment of the present disclosure. The method 200 of unraveling a single braid may include untying or cutting 202 the braid at a desired distance from the user's head or scalp, leaving a length of braid still attached to the user's real hair to be unraveled. The braid length after untying or cutting, may be, for example, approximately 10-12 inches. The section of the braid that is cut or untied typically may not be composed of the user's natural hair that is braided, but instead would be composed of the synthetic braid extensions that were added during the prior braiding process. It is contemplated that braids of length shorter than the longitudinal length of the braid channel 102*b* or the pipe 102*c* may be unraveled by the device 100. If the braid is shorter than the length of the pipe 102*c*, the device 100 may be configured to start the unraveling process at a different Z direction 124 position within the braid channel 102*b*. This may be accomplished with an app (described below) executed on a computer, tablet, smartphone, or the like at setup time of the device 100 or may be adaptively done using software or firmware stored in and executed by the controller board 110. For example, the tines 120*a* and 120*b* may be moved up the braid channel 102*b* in an iterative fashion until some resistance to further movement because of the presence of the braid is detected by the controller board 110 and such detection may be used to set a start location for unraveling the braid in the Z direction 124.

Sometimes it may be difficult to determine exactly where only the user's natural hair begins near where it is untied or cut to become the lowest portion of the braid to be unraveled. The portion of the braid right where and somewhat above where the cut is made (i.e., toward the scalp) may consist of only the user's natural hair still braided, only other natural hair (i.e., not made of the user's natural hair) still braided, only synthetic hair still braided, or a combination thereof.

Although the device 100 is contemplated to unravel up to a particular length of braid, such as approximately 10-12 inches, as described above, it is contemplated that braids of lengths other than approximately 10-12 inches, both shorter or longer, may instead be unraveled. For braids longer than the pipe 102*c*, once a first particular length of braid is unraveled, it may be possible to remove the device 100 (e.g., by opening the lid 102*a*) and then position it further up the braid (or reinsert the braid with its already unraveled section further into and through the braid channel 102*b*) and then reattach the device 100 (e.g., by closing the lid 102*a* to form the pipe 102*c*) at a position above the already unraveled section to start the unraveling process again on the next higher still-braided section. Whether just a particular length is unraveled or successive section lengths are unraveled, the user may have to or want to use or run their fingers, comb, brush, etc., or a combination thereof, through the lower part of the unraveled hair or braid to help make sure it is or remains untangled at the bottom of the pipe 102*c* where it hangs or extends out of the device 100, as described above. In this manner, the device 100 may be moved to sequentially higher and higher sections still braided toward the user's scalp, unraveling each section in turn.

Referring to FIG. 5 again, more specifically, to unravel the braid, with the braid cut or untied and the lid 102*a* open, the user may hold the handle 103 with one hand and with the other hand places or pushes 204 the braid into and through the braid channel 102*b* (i.e., all the way through the longitudinally elongated pipe 102*c*), leaving a short length of the braid, for example, up to a couple of inches, between the user's scalp and the topmost portion of the braid that is inserted into the top portion of the device 100. This is done to leave a gap between the scalp and the device 100 to protect the user if the braid becomes entangled in the device and the device turns off automatically if detected by the processor of the controller board 110, or if the user lets go of the failsafe switch 106 to immediately turn off the device. The braid generally should be laid or allowed to hang down along the longitudinal length of the pipe 102*c* to be underneath the retainers 130*a* and 130*b* from top to bottom of the pipe 102*c*, and as mentioned above, leaving a small length of the distal end of the braid to extend from the bottom of the pipe 102*c*.

After the braid is inserted fully into the device 100, the portion of the braid above or just above what will be unraveled may be clamped 206 by a clamp or clip 108 located at the top of the pipe or clamped upon closing the lid 102*a*. The clamp or clip 108 (see FIG. 2*a*) may be similar to and function like a hairclip, such as those with opposed sets of teeth or tines, and one such set may be affixed to or form part of the lid 102*a* and the other opposing set be affixed to or form part of the upper portion of the braid channel 102*b* with the opposed sets of teeth or tines projecting towards each other for clamping or clipping the top of the braid when the lid 102*a* is closed. Alternatively, a hairclip having opposed teeth, but separate from and not attached to move with the lid 102*a* (i.e., the clip swivels separately from the lid 102*a*), may be used instead. This type of hairclip, because it is part of the device 100 and can support the weight of the braid once it is attached to the braid, would free up the user's hands to allow them to open or close the lid 102*a* to insert into or remove the braid from the braid channel 102*b*.

The user holds 208 the device by the handle 103 and closes 210 the lid 102*a* with the braid secured in place underneath both retainers 130*a* and 130*b*. The tines 120*a* and 120*b* typically would be initially located at or near the bottom of the device 100 and positioned outside of where the braid is or would be (in the XY plane), and preferably not making contact with it if the braid is inserted. This is the "home" position of the actuators 116*a* and 116*b* (and of the tines 120*a* and 120*b*), which may be a default position, for example, when the lid 102*a* is open. FIG. 2*b* shows the actuators 116*a* and 116*b* in the home position. There also may be a limit switch (not shown) included in the device 100 such that when the actuators 116*a* and 116*b* are in the home position (e.g., flush with the handle 103), the limit switch notifies the controller board 110 that the home position has been reached.

If the tines 120*a* and 120*b* are not initially in the home position, a "home" button, switch, or selector (not shown), which may be on a built-in display screen (or as part of a haptic) on the handle 103, whether implemented in hardware or software, or a combination of both, may be pressed, selected, or touched to move them there. If the motor 112 is a closed loop stepper motor, an encoder (not shown) may be included with it or elsewhere in the device 100 that would allow the position of the tines 120*a* and 120*b*, including the home position, to be determined at all times based on a count or counter. For example, a count of electrical or electronic pulses from the encoder corresponding to a rotational position of the motor 112 or the threaded rod 122 may be transmitted to the controller board 110 to provide an evaluation of the location of the actuators 116*a* and 116*b* and of the "successful" operation of the tines 120*a* and 120*b* (i.e., the success of the tines 120*a* and 120*b* in being able to pull down or "break" the braid for unraveling). Such successful operation may depend on the particular unraveling control algorithm executed by the processor in the controller board 110. For example, a comparison may be made between the encoder values derived from the angular position or movement of the shaft (not shown) of the motor (e.g., a stepper motor) 112 (mechanically coupled to drive the threaded rod 122) and the motor pulses transmitted by the processor that are used to adjust the angular position of the shaft to judge whether a successful unraveling of the braid has occurred. This comparison or any difference that is determined may provide information about the tines 120*a* and 120*b* having difficulty breaking the braid, so to correct this situation, the speed of the motor 112 and/or of the actuators 116*a* and 116*b* may be slowed down to increase the torque and the force for movement of the tines 120*a* and/or 120*b* as needed. For example, the frequency of motor pulses may need to be decreased (to increase the torque) or increased up (to decrease the torque) or other algorithm changes made, including to produce additional "jiggling" of the tines 120*a* and 120*b* to loosen the braid, and/or to reverse the motor (112), and/or to make adjustments of the linear actuators 116*a* and 116*b*. Such implementations may successfully break the knot of the braid for the device 100 to enter the pulling down or combing out stage for moving down (in the Z direction 124) along or through the lower loose section of the braid within the pipe 102*c* to unravel it and to prevent or reduce the likelihood of tangles. On the other hand, the success of the tines 120*a* and/or 120*b* in penetrating the braid may be measured by detecting resistance (i.e., mechanical resistance). If there is no resistance, it may mean a miss to hitting or penetrating the braid or a combing out. If there is resistance, the adjustment to rotation (torque) described above may need to be made to break the braid and go into the combing out state.

A limit switch may provide a way to calibrate the Z position 124 of the actuators 116*a* and 116*b* (and the tines 120*a* and 120*b*) at any time, for example, after a power loss or a reset, or upon turn-on, etc. of the device 100. If the actuators 116*a* and 116*b* are open loop actuators, limit switches and timers may be used to set calibration, such that if the home position is not reached in a set time when called for, the tines 120*a* and 120*b* may withdraw from the braid and be sent to home position. Providing a limit switch in the home position of the actuator indicates that the tines 120*a* and 120*b* are safely out of the braid channel 102*b*.

Then the unraveling may begin at the bottom of the braid in the pipe 102*c*. By activation of the motor 112 to move the actuators 116*a* and 116*b* up the threaded rod 122, the tines 120*a* and 120*b* may move 212 in the Z direction 124 along or up the braid in successive ⅛-inch increments. If the braid becomes or is sensed to be entangled improperly, as detected by the processor of the controller board 110 or if the user lets go of the failsafe switch 106, a safety feature is activated 214 and the device stops or turns off 216 automatically. If the safety feature is not activated, one or both of the times 120*a* and 120*b* puncture the braid 218 at a position close to the middle or somewhere else within the width of the braid. Because the braid may be off to one side of the braid channel 102*b*, the tines 120*a* and/or 120*b* may miss the middle along the width of the braid when puncturing it. The tines 120*a* and/or 120*b* also may be offset from each other as shown in FIG. 3*a*. This provides a "fork" configuration between the tines 120*a* and 120*b* that may increase the probability of the braid being puncture successfully for unraveling.

The intent is to have the tines 120*a* and 120*b* puncture all the way through the thickness of the braid. But depending on the size or type of braid, the device may operate the tines 120*a* and 120*b* to only puncture part way through the width of the braid at a particular Z direction position before unraveling only that punctured portion, as described below, and then return repeatedly, as necessary, to puncture and further unravel the remaining braid width at that same Z direction position before incrementing to a new Z direction position. Again, if the safety feature is activated 214, the device stops or turns off 216 automatically. If the safety feature is not activated, continuing with FIG. 5 (whether the braid width is completely punctured or only partially punctured), the tines 120*a* and 120*b* are articulated, as described herein, and pull down the punctured portion of the braid 220 to the lowest position of the tines 120*a* and 120*b* at the bottom of the pipe 102*c* to unravel or untangle the portion of the braid being pulled. Again, if the safety feature is activated 214, the device stops or turns off 216 automatically. If the safety feature is not activated, then it is determined if the braid has been fully unraveled 222. If it has been fully unraveled, the tines 120*a* and 120*b* may then move in the XY plane out of or away from the unraveled braid to the home position, preferably not touching the unraveled braid and the device stops or turns off 216 automatically. If the braid has not been fully unraveled, the tines 120*a* and 120*b* may instead move out of or away from the braid and then directly to the next ⅛-inch increment position up the braid 212 to continue the unraveling without first going to the home position in between such increments. In certain embodiments, the tines 120*a* and 120*b* may first move to the home position before moving to the next increment position up the braid. It should be understood that increments other than ⅛ inch may be used, such as 3⁄16 inch or ¼ inch, depending on the type of braid, its size, weave tightness, length, style, hair type, etc. Moreover, a combination of different increments may be used for the same reasons.

While inserting into or puncturing and/or pulling down and unraveling the braid, both tines 120*a* and 120*b* may be articulated (in some instances, "jiggled" or "wiggled," in short oscillating or other algorithmic motions) in any or all of the three dimensions (X, Y, and Z), as described above, to puncture or work their way into the braid and/or to help unravel it when pulling it down. Either or both of the tines 120*a* and 120*b* may be so articulated in the transverse (XY plane) directions by operation of the actuators 116*a* and 116*b* and movement of the arms 118*a* and 118*b*, and both may be articulated in the Z direction by activation of the motor 112 before being moved longitudinally or while being moved longitudinally in the Z direction down by further operation of the motor 112 to unravel the braid. The tines 120*a* and 120*b* are used essentially as "fingers" to work their way into the braid, open it up or pull it apart, and pull it down the pipe 102*c* to unravel it. The oscillatory, jiggling, or wiggling motion may also help keep the hair from tangling as the braid is pulled and unraveled. The safety feature or tension detection, as described herein, may stop the tines 120*a* and/or 120*b* from pulling too strongly in any direction on the braid if the force exceeds a certain threshold or limit, as would be determined by too much current being drawn on the motor 112, or the encoder detecting limited or no movement of the shaft of the motor 112, or by too much current being drawn on the actuators 116*a* and/or 116*b*, or a combination of the aforementioned. Once the tines 120*a* and/or 120*b* are determined to be stuck, the processor may initiate a recovery procedure of motion to free the tines 120*a* and/or 120*b* like that described above for breaking or penetrating the braid. If the stuck tines 120*a* and/or 120*b* are freed, the unravel process continues. If the tines 120*a* and/or 120*b* are determined to still be stuck, the safety feature described herein may be activated, or the tines 120*a* and 120*b* will be moved to the home position of the actuators 116*a* and 116*b* by turning the shaft of the motor 112 to drive the threaded rod 122, and then the safety feature may be activated so the user may assist in breaking the braid. One possible solution may be to monitor the pulses sent out from the processor on the controller board 110 that drive the motor 112 versus the encoder measurement values returned to the processor, in similarity to the discussion above. For example, if there are pulses sent from the processor, but no encoder values measured, the tines 120*a* and/or 120*b* may be stuck. Once the tines 120*a* and/or 120*b* are determined to be stuck, they may be withdrawn from the braid and repositioned further down the braid to get below the knot or stuck location to continue operation. If, after a limited number of attempts to free the tines 120*a* and/or 120*b* or timeout value is reached, the device 100 may stop and help from the user would be needed. This safety feature, or tension or force detection, would operate under control of the processor on the controller board 110.

Referring again to FIG. 5, the method 200 steps that do not involve human activity may be implemented in hardware or a suitable combination of hardware and software, and a special-purpose processor may be used to control the device 100's modes of operation. For example, a processor from the OSD335x System-in-Package (SiP) family of devices, available from Octavo Systems, based on the Texas Instruments AM335x System on Chip (SoC) (see https://octavosystems.com/app_notes/end-equipment/cnc-system-in-package/), may be used. Alternatively, general purpose (off the shelf component) may be used to implement the functionality of the device and methods described herein. For example, a 32-bit PSoC™ 6 Arm® Cortex®-M4/M0+, available from Infineon Technologies AG (see https://www.infineon.com/cms/en/product/microcontroller/32-bit-psoc-arm-cortex-microcontroller/psoc-6-32-bit-arm-cortex-m4-mcu/) may be used. Whether implemented by special-purpose or general-purpose hardware, various settings of the device 100 may include speed, force (tine pulling force), size of braid, and hair type (e.g., synthetic or natural). It is contemplated that, in other embodiments, such as in commercial grade systems of the device 100 for use in a salon, multiple braids may be handled. These embodiments may include multiple sets of motors, threaded rods, actuators, tines, etc., which would implement the same or similar methods as described herein, to unravel multiple braids. Such a commercial product likely would be somewhat larger (e.g., 12-inches (standard), 24-inches, or 36-inches in length), heavier, and more expensive. Moreover, a shoulder attachment or support, or a table top rest or support, may be used with such a commercial product, although it is possible a shoulder attachment, rest, or support may also be used with the device 100 described herein that is not the commercial product.

Although the method 200 described above is shown as a flowchart, the order of steps is exemplary and may be modified, supplemented or reduced as needed. In addition, the method 200 steps that do not involve human activity may be implemented as a state diagram, using object-oriented programming or in other suitable manners.

Figure 6:
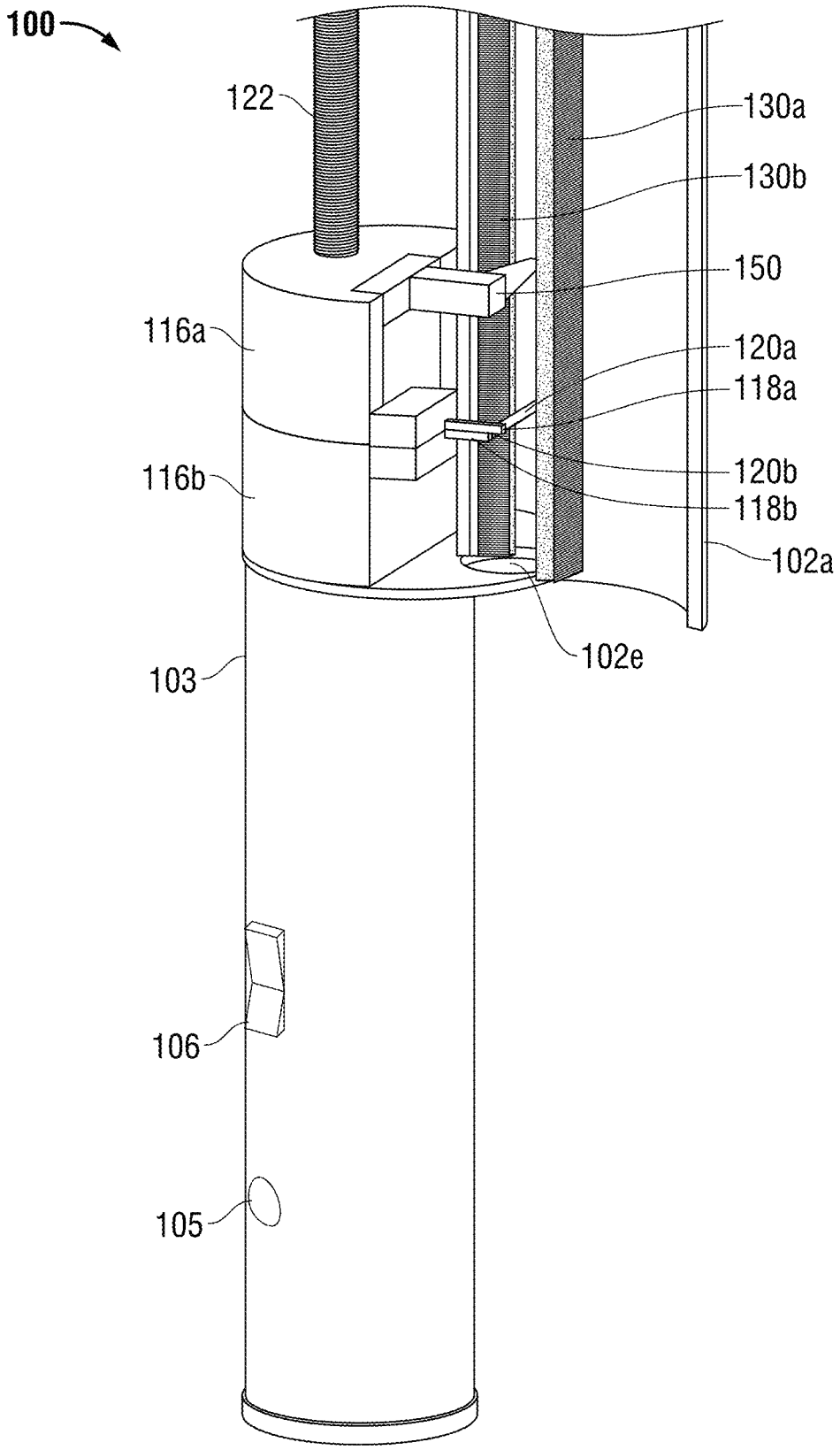
FIG. 6 shows a suppressor, in a variation of the embodiment of FIG. 1, in accordance with exemplary embodiments of the present disclosure.

In accordance with exemplary embodiments of the present disclosure, as illustrated in FIG. 6, a suppressor, appendage, or adjunct 150 (hereinafter, suppressor) also may be included in the device 100. The suppressor 150 may be fixedly attached to the actuator 116*a*, or it may be moveably attached to, and driven by, the actuator 116*a*, and spaced from the tine 120*a*. The end of the suppressor 150 away from the actuator 116*a* is intended to poke through the retainers 130*a* and 130*b* toward the braid channel 102*b*. As the tines 120*a* and 120*b* puncture, passes through, and move down the pipe 102*c* to unravel, unwind, or untangle the braid, the suppressor 150 follows the upper tine 120*a* and may act somewhat analogous to a "finger" to suppress the expansion or fluffiness of the braid, as mentioned above, by also brushing or passing through the unraveled portion of the braid to keep or tamp down the unraveled portion retained or contained below the retainers 130*a* and 130*b*, which may otherwise escape. The unraveled portion may need to be suppressed to allow for the tines to move up to the next incremental still-braided or entangled position up the braid. The suppressor 150, if it is moveably attached to, and driven by, the actuator 116*a*, may move above or out from poking through the retainers 130*a* and 130*b* when the tines 120*a* and 120*b* move incrementally up the device 100 to the next position to continue unraveling the braid, as described above. At that point, the suppressor 150 would again poke through the retainers 130*a* and 130*b* to suppress the expansion of the braid again, and so on. Code, as described herein, may be included for the suppressor to actuate its movement. If the suppressor 150 is fixedly attached to the actuator 116*a* instead of moveably attached to it, the suppressor would just move up and down the pipe 102*c* along with the tines 120*a* and 120*b* while continuing to poke through the retainers 130*a* and 130*b* to suppress the expansion of the braid.

In accordance with exemplary embodiments of the present disclosure, the device 100 may further include an application ("App" or "app") or software whose code is stored in memory (not shown, but which may be located in the handle 103 and/or on the controller board 110), such as firmware, DRAM, SRAM, other types of random access memory, flash memory, solid-state memory, EEPROM, or the like, and executed by a processor of the controller board 110. Alternatively, the device may be controlled by the app being executed on a computer, tablet, smartphone, or the like communicating with the device through the connection 104 or through a wireless-type connection, such as by Bluetooth or WiFi, in which case, supporting semiconductor chips, SoCs, or other modules and associated code would be included in the device 100, for example, as part of the controller board 110. The app code would control the operation of the device 100 as described herein. For example, the code or software may provide control of various functions: (1) on or off function; (2) pressure, force, or tension choices associated with the movement of the tines 120*a* and 120*b* or the suppressor 150 in XYZ dimensions to account for differences between the physical characteristics or properties of natural hair and synthetic hair or for different sizes or types of braids; and (3) a fail-safe mechanism, as described herein, such that if the motor 112, the actuators, 116*a* and 116*b*, or other component gets jammed or the hair gets too or more entangled, the tines 120*a* and 120*b* will release the braid immediately so as not to pull the hair/braid further, or the device 100 will automatically stop or turn off. The failsafe mechanism may automatically pull the tines 120*a* and 120*b* out and away from the braid or to the home position and may also open the lid 102*a*. Or a switch or latch release (not shown) may be included on or with the lid 102*a* such that the lid 102*a* will not fully open until the tines 120*a* and 120*b* are out of the braid channel 102*b* or at the home position. The failsafe mechanism also may operate upon loss of power to the device 100 or any time when the lid 102*a* opens such that everything stops. The intent would be to have no moving parts when there could be fingers within the device 100.

The app also may be responsive to user input, such as to allow the user to change the settings of the device to best unravel a particular type of braid or other settings. For example, the app may allow the user to input their braid specifications (size, weave tightness, length, style, hair type (e.g., synthetic or real hair), hair texture, brand (e.g., X-Pression®, Rebundle®, Dosso Beauty™, etc.), wet or dry, etc.). A display with hardware buttons or switches, software buttons or switches, or a haptic, or their combination may be included on the handle or elsewhere on the device 100 for these purposes. In some embodiments, the device 100 may keep track of the time it takes to unravel a braid for informing the user or for collecting usage information for support and/or for product updates.

It should be emphasized that the above-described embodiments are merely examples of possible implementations. Many variations and modifications may be made to the above-described embodiments without departing from the principles of the present disclosure. For example, it is contemplated that instead of two tines, such as the tines 120*a* and 120*b*, just one of these tines may be included in the device and operate similarly to what has been described herein for unraveling a braid while the other tine remains outside the braid or the second tine and its actuator are not included in the embodiment at all. Moreover, with a corresponding increase in the number of actuators, it is contemplated that three or more tines may operate similarly to what has been described herein to unravel a braid. Thus, in certain embodiments, one or more tines and a corresponding number of actuators may be used to unravel a braid. Furthermore, in certain embodiments, the handle 103 may include haptics or buttons for mode, speed, control, battery charge level, and other functions. In addition, in certain embodiments, a button, pressure sensor, haptic, or the like may be included on the handle that the user must press or touch with their hand while holding the device 100 to be able to use the device 100 or it will not operate. This is another possible failsafe mechanism. Release of it also may automatically turns the device off. All such modifications and variations are intended to be included herein within the scope of this disclosure and protected by the following claims.

The invention claimed is:

1. A method of unraveling a hair braid using a device, comprising inserting a braid within a pipe formed by a braid channel and a lid; and moving a tine within the pipe to unravel the braid, wherein the moving the tine further comprises activating an electromechanical drive for moving the tine, and further comprising comparing an encoder measured value and a pulse count or frequency to determine a position of the electromechanical drive.

2. The method of claim 1, wherein the inserting a braid within the pipe further comprises inserting the braid under retainers.

3. The method of claim 1, wherein the moving the tine within the pipe further comprises activating an electromechanical drive to move the tine.

4. The method of claim 1, wherein the braid is unraveled in increments.

5. The method of claim 1, further comprising moving a second tine within the pipe to unravel the braid.

6. The method of claim 1, further comprising moving, in one dimension, an electromechanical drive, coupled to the tine, and wherein moving the tine further comprises moving the tine in a plane perpendicular to the one dimension.

7. The method of claim 1, wherein the moving the tine comprises penetrating the braid and moving the tine down the pipe to unravel the braid.

8. The method of claim 7, further comprising, if the tine becomes stuck, controlling motion of the tine to make it unstuck.

* * * * *